United States Patent [19]

Vallarino

[11] Patent Number: 4,576,908

[45] Date of Patent: Mar. 18, 1986

[54] ULTRAVIOLET ABSORBER IN PHOTOGRAPHIC ELEMENTS

[75] Inventor: Angelo Vallarino, Savona, Italy

[73] Assignee: Minnesota Mining and Manufacturing Company, St. Paul, Minn.

[21] Appl. No.: 618,905

[22] Filed: Jun. 8, 1984

[30] Foreign Application Priority Data

Jun. 7, 1983 [IT] Italy ..... 65211 A/83

[51] Int. Cl.[4] ..... G03C 1/84

[52] U.S. Cl. ..... 430/512; 430/523; 430/931; 430/961

[58] Field of Search ..... 430/512, 523, 931, 961

[56] References Cited

U.S. PATENT DOCUMENTS

| | | | |
|---|---|---|---|
| 3,004,896 | 10/1961 | Heller et al. | 430/931 |
| 3,253,921 | 5/1966 | Sawdey | 430/512 |
| 3,649,276 | 3/1972 | Sano et al. | 96/55 |
| 4,045,229 | 8/1977 | Weber et al. | 430/512 |
| 4,195,999 | 4/1980 | Adachi et al. | 430/512 |
| 4,307,184 | 12/1981 | Beretta et al. | 430/512 |
| 4,323,633 | 4/1982 | Beretta | 430/512 |
| 4,443,534 | 4/1984 | Kojima et al. | 430/512 |

*Primary Examiner*—Jack P. Brammer

*Attorney, Agent, or Firm*—Donald M. Sell; James A. Smith; Mark A. Litman

[57] ABSTRACT

3-Aminoallylidenemalononitrile is useful for absorbing ultraviolet radiation near 400 nm, with no absorption near 420 nm, when directly dispersed in a photographic gelatin layer.

7 Claims, 1 Drawing Figure

100
08
06
04
02
0
200
300
400
500
9
10
11

ULTRAVIOLET ABSORBER IN PHOTOGRAPHIC ELEMENTS

TECHNICAL FIELD

The present invention refers to the introduction of ultraviolet absorber compounds in photographic material layers, and, particularly, in layers of color photographic materials.

More precisely, this invention refers to 3-diallylaminoallylidenemalononitrile dispersed in said layers.

BACKGROUND OF THE ART

It is common knowledge that silver halide emulsions are inherently sensitive to blue and ultraviolet radiation, while they are not sensitive to green and red radiations. For normal color photography processes, it is necessary to make these emulsions sensitive to green and red by means of spectral sensitizers (e.g. cyanide dyes) well known to the skilled in the art.

It is also well-known that ultraviolet radiation can harm the chromatic equilibrium of the photographic color images (intended as the capacity of such images to reproduce real images with the same color balance seen by human eye), because they produce a spurious UV-initiated image and therefore cause the formation of color, without any connection with the real images as seen by human eye, which does not see UV radiations, i.e. those shorter than about 420 nm. This radiation, furthermore, has destructive effects on the materials which form the photographic image when they are exposed to the light after the treatment. Color paper, for example, after having been exposed and treated, undergoes a color degradation if it does not contain a suitable ultraviolet absorber.

Compounds which protect photographic materials from the destructive effects of UV radiations efficaciously, such as hydroxy-phenylbenzotriazole compounds, have been described in various patents including U.S. Pat. Nos. 3,004,896, 3,253,921 and 4,323,633. These compounds have found large use in photography, particularly color photography.

They cannot be used, however, to prevent UV radiation from disturbing the chromatic equilibrium of photographic images.

In order to accomplish this result, in fact, compounds are to be used which absorb the ultraviolet radiation near 400 nm and not that near 420 nm, while the above mentioned hydroxy-phenylbenzotriazole compounds absorb between 300 and 370 nm.

Even if some compounds with such absorption characteristics were known, they can loose those characteristics when introduced into the layers by the normal techniques known in the art, such as the dispersion technique. An example of this is represented by compounds derived from aminoallylidenemalononitrile (such as dihexylaminoallylidenemalononitrile) whose preparation is described in *Chem. Ber.*, Vol. 103, pages 222–235 (1970), which have shown to be compounds with a high and sharp absorption near 400 nm (and a high molar extinction coefficient), without absorbing the radiations near 420 nm. Unfortunately, they have been shown to lose their characteristics when introduced in the photographic layer according to the above-mentioned dispersion method (see U.S. Pat. No. 4,045,229). To obviate this disadvantage, the loaded polymer technique has been suggested (see BE Pat. No. 833,512) which consists in loading solid particles of a particular polymeric latex with an aminoallylidenemalonoitrile hydrophobic derivative and in mixing the so-loaded latex with the photographic layer gelatin, in which the UV absorber compound must be introduced. This technique, however, has the disadvantage that it is not suitable for obtaining consistent, reproducible results. Besides, not every polymeric latex is suitable for this aim and those that are suitable are of difficult preparation and expensive. Furthermore, the high latex/UV absorber compound ratio makes necessary the use of quantities of latex which are too high and negatively affect the physical characteristics of the layer containing it.

U.S. Pat. No. 4,307,184 has described polymeric compounds including ultraviolet absorber aminoallylidene units obtained upon copolymerization of 3-aminoallylidenemalononitrile with an ethylenically unsaturated monomer (such as an acrylic monomer). This technique appears to be more complicated than the normal dispersion techniques known in the art (see for example the above cited patents and U.S. Pat. Nos. 2,322,027; 2,533,514; 2,801,171; 2,870,012; 2,991,177; 2,739,888; 3,253,921 and British Pat. No. 1,357,372).

Briefly, the solvent dispersion technique consists in dissolving a compound in an organic solvent and then dispersing the obtained solution with an aqueous medium such as water or a gelatin in water solution. The obtained dispersion can either be directly introduced into the photographic composition before coating or can be dried to remove part or all the organic solvent prior to such introduction. In one case, high-boiling (water-immiscible) organic solvents are to be used. In the second, low-boiling organic solvents are to be used alone or mixed with high-boiling organic solvents.

SUMMARY OF THE INVENTION

The present invention describes a photographic material including in one of its layers, dispersed therein, a compound which absorbs the ultraviolet radiation near 400 nm and not near 420 nm.

The present invention describes 3-diallylaminoallylidenemalononitrile as a UV-absorbing compound which can be introduced into photographic layers dispersed therein to absorb near 400 nm (and not near 420 nm).

DETAILED DESCRIPTION OF THE INVENTION

Figure 1:
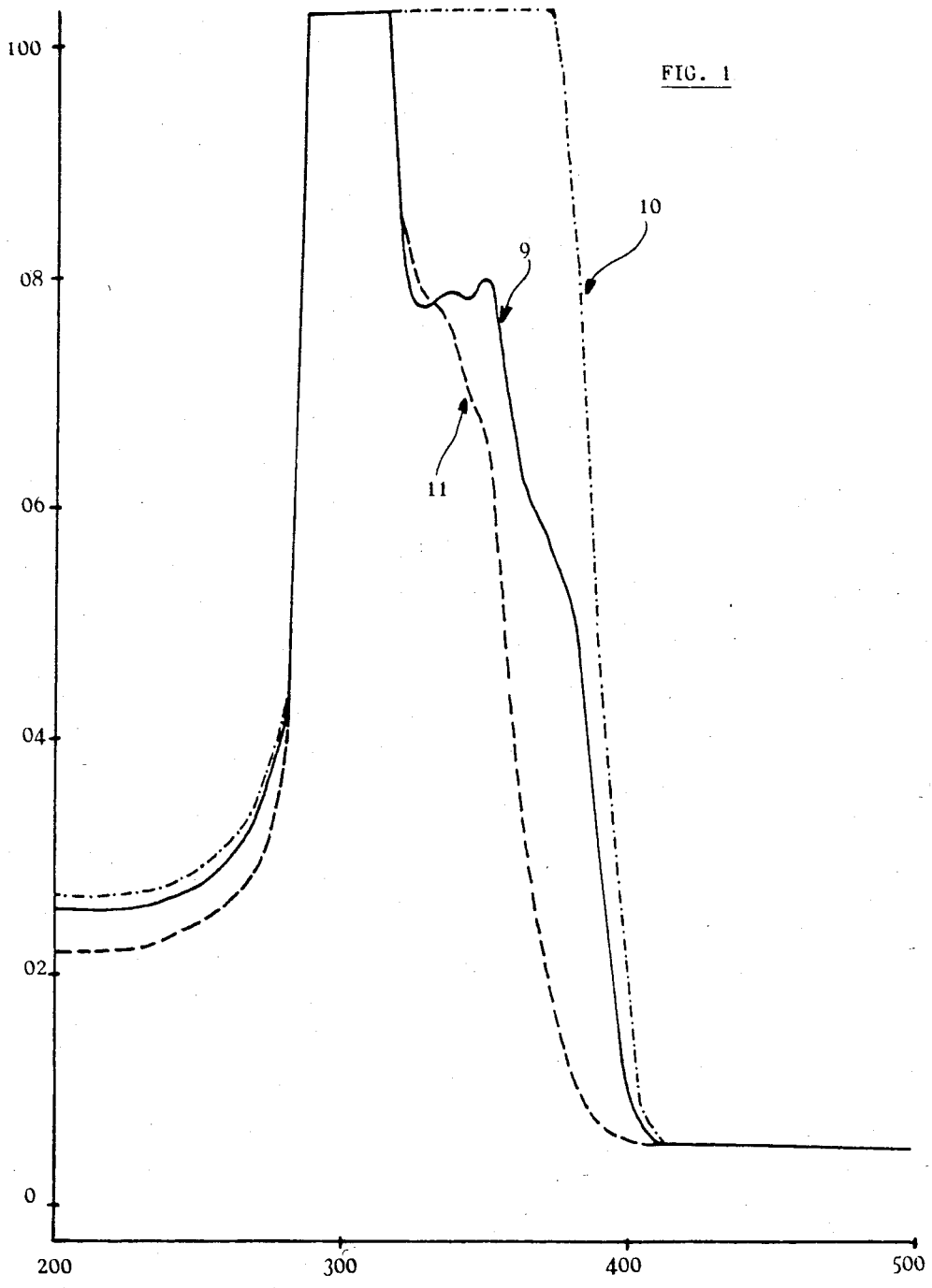

It has been proved that 3-diallylaminoallylidenemalononitrile behaves differently with respect to similar compounds (such as, for example, 3-dipropylaminoallylidenemalononitrile) which have an undesired absorption at 415 nm when directly dispersed in photographic layers ("directly dispersed" meaning dispersed after having been dissolved in water or in organic solvents known in the art and "indirectly dispersed", on the contrary, meaning dispersed through a physical or chemical-physical association different from a solution, such as the chemical-physical association established between the compound and the latex, according to the loaded latex technique, with the exclusion of the chemical bonds established in a polymer among different monomer units).

According to the present invention, in fact, when directly dispersed in a photographic layer, 3-diallylaminoallylidenemalononitrile has a high (and sharp)

absorption near 400 nm with no undesired absorption near 420 nm (or with no significant absorption at 415 nm).

The compound also has good absorption characteristics when indirectly dispersed in a photographic layer, that is, for example, when loaded on a latex according to the loaded latex technique known in the art (see for example U.S. Pat. Nos. 4,133,687, 4,199,363, 4,214,047 and the European Patent Application No. 14,921). In particular, it has been found that this technique can be used with 3-diallylaminomalononitrile at lower polymer/UV absorber compound ratio (which allows thinner layers to be made).

The present invention, therefore, refers to a photographic material comprising at least a silver halide layer and, at least, an auxiliary layer coated on a supporting base, one of said layer including, dispersed therein, a 3-aminoallylidenemalononitrile derivative, characterized by the fact that such derivative is 3-diallylaminoallylidenemalononitrile.

Preferably, the present invention refers to the above photographic material in which said layer is an auxiliary layer, in particular an external protective layer. More preferably, such layers are substantially made of gelatin.

In particular, the present invention refers to the above mentioned photographic material in which said silver halide emulsion layer is optically sensitized and is associated with a color-forming coupler.

More precisely, the present invention refers to the above mentioned photographic material in which said silver halide emulsion layer or said auxiliary layer contain, dispersed therein, 3-diallylaminoallylidenemalononitrile, dissolved in a high-boiling water-immiscible or substantially water-immiscible organic solvent.

In another aspect, the present invention refers to a method to improve the chromatic equilibrium of color images obtained with a silver halide color coupler containing photographic material, characterized by the introduction into said material, more precisely into an emulsion layer and/or auxiliary layer thereof, of 3-diallylaminoallylidenemalononitrile dispersed in an aqueous gelatin composition dissolved in a high-boiling water-immiscible organic solvent.

3-diallylaminoallylidenemalononitrile turned out to be very useful, as UV absorber to absorb UV radiations near 400 nm (with no absorption at 420 nm), not only when dispersed, but also when loaded in a latex dispersed in a layer of a photographic color material.

As already indicated, however, to the purposes of the present invention, it is preferable to introduce such compound into the photographic layers by the dispersion technique.

Among others, such technique is very useful to introduce in the same dispersion different products, for example couplers and other auxiliaries such as UV absorbers.

To the purpose of the present invention, it has been found to be useful, for example, to use a combination of 3-diallyaminoallylidenemalononitrile with a (hydrophobic) 2-(2'-hydroxyphenyl)benzotriazole dispersed in a photographic layer dissolved (together) in the same high boiling water-immiscible organic solvent.

The solvents particularly useful to this technique are those described in the above cited patents.

High-boiling organic solvents within the group of phosphate esters are, particularly, the following: triphenylphosphate, tricresylphosphate, diphenyl-mono-p-tert.-butylphenylphosphate, monophenyl-di-p-tert.-butylphenylphosphate, diphenylmono-o-chlorophenylphosphate, monophenyl-di-o-chlorophenylphosphate, tri-p-tert.-butylphenylphosphate, tri-o-phenylphenylphosphate, di-p-tert.-butylphenylmono-(5-tert.-butyl-2-phenylphenyl)-phosphate.

High-boiling organic solvents within the group of amides are the following: acetyl-n-butyl-aniline, acetylmethyl-p-toluidine, benzoylpiperidine, N-n-amylphthalimide, N-n-amylsucinimide, N-2-cyanobutylphthalimide, N,N-diethyllauramide, N,N-di-n-butyllauramide, N,N-diethylsteramide, N,N-diethylcapamide, N,N-dipropylacetamide, N,N-ethylbutyllauramide, N,N-didecyllauramide, N,N-dinonylstearamide, N,N-dibutylarachidamide, N,N-dibutylcaproamide, N,N'-tetrabutylsuccinamide, N,N'-tetrahexyladipamide, N,N'-tetradecylmalonamide.

High-boiling solvents can be chosen also within the group of phthalates such as methylphthalate, ethylphthalate, propylphthalate, n-butylphthalate, di-n-butylphthalate, n-amylphthalate, isoamylphthalate and dioctylphthalate.

Low-boiling water-insoluble organic solvents include methyl, ethyl, propyl and butyl acetates, isopropylacetate, ethylpropionate, sec.-butylalcohol, carbontetrachloride and chloroform. Water-soluble organic solvents (which are removed from the emulsion by washing with water) include methyl isobutylketone, β-ethoxyethylacetate, β-butoxy-β-ethoxy-ethylacetate(diethyleneglycolmonoacetate), methoxytriglycolacetate, methylcellosolve acetate, acetonylacetone, diacetone alcohol, butylcarbitol, ethyleneglycolmonobutylether, methylcarbitol, ethyleneglycolmonomethylether, ethyleneglycol, diethyleneglycol and dipropyleneglycol.

EXAMPLE 1

The following table reports the absorption maxima (λmax) and the extinction coefficients (εmax), as measured with a spectrophotometer in methanolic solution, of the compounds corresponding to formula:

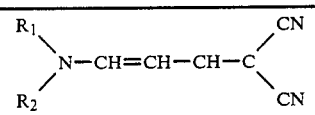

| Comp. | $R_1=R_2$ | λmax (nm) | εmax |
|---|---|---|---|
| A | $C_6H_{13}$(n) | 376 | $6.45 \times 10^4$ |
| B | $C_4H_9$(n) | 376 | $6.53 \times 10^4$ |
| C | $C_3H_7$(n) | 376 | $6.79 \times 10^4$ |
| D | $CH_2=CH-CH_2$ | 374 | $6.85 \times 10^4$ |
| E | $C_2H_5$ | 374 | $6.43 \times 10^4$ |
| F | $CH_3$ | 372 | $6.33 \times 10^4$ |
| G | pyrolidino | 378 | $6.75 \times 10^4$ |
| H | pyperidino | 376 | $7.11 \times 10^4$ |
| I | $CH\equiv C-CH_2$ | 374 | $5.85 \times 10^4$ |

EXAMPLE 2

The UV-absorbing compounds of Example 1 were dispersed in gelatin loaded on droplets of a polyurethane latex, (viz. Latex 280A of Onyx).

The dispersion was prepared by dissolving the UV-absorber in acetone (50 ml. of acetone per each gram of the product) and adding the latex to such a solution. The obtained solution was then stirred for 5 minutes and the acetone was evaporated under vacuum (~80 mm/Hg) at 30° C. The so-obtained mixture was filtered, added with 20 ml. of a 10% gelatin aqueous solution containing 0.5 ml. of a 10% aqueous solution of Hostapur ®SAS93 (a $C_{11}$–$C_{17}$ straight chain alkyl sulfonate sodium salt) and brought to a final weight of 100 grams.

The reference UV absorbing compounds A, B and C (outside the scope of the present invention) were loaded at the maximum concentration of 1% weight to weight with respect to the dispersion and at a polymer/UV absorber ratio of 5:1.

The UV absorbing compound D of the present invention was loaded at the maximum concentration of 2% weight to weight with respect to the dispersion and at a polymer/UV absorber ratio of 3:1.

All other reference UV absorbing compounds, viz. E, F, G, H and I (outside the scope of the present invention), could not be loaded in the above conditions due both to a poor solvent solubility and crystallization from the composition.

The gelatin dispersions of the latex-loaded UV-absorbing compounds were added with a gelatin hardener and then coated onto a cellulose triacetate base at the coverage of 0.2 g/m² of UV-absorber (the compound D containing layer turned out to have about half the thickness of the reference compound containing layers).

The following table reports the optical density values read at the spectrophotometer at 375 nm and 415 nm, respectively.

| Film | Comp. | $R_1$=$R_2$ | Optical density read at 375 nm | Optical density read at 415 nm |
|---|---|---|---|---|
| 1 | A | $C_6H_{13}$(n) | 1.30 | 0.05 |
| 2 | B | $C_4H_9$(n) | 1.86 | 0.05 |
| 3 | C | $C_3H_7$(n) | 1.83 | 0.05 |
| 4 | D | $CH_2$=CH—$CH_2$ | 1.92 | 0.05 |

The above reported data show a higher UV-absorption for the UV-absorbing compound (D) of the present invention coated on a gelatin layer having a thickness of about the half the thickness of the layers containing the reference UV-absorbing compounds.

EXAMPLE 3

The UV-absorbing compounds of Example 1 were dispersed in gelatin dissolved in droplets of a water-immiscible solvent, according to the following composition:

UV-absorbing compound: 8 g
Tricresylphosphate: 1.5 g
Dibutylphthalate: 1.5 g
Ethyl acetate: 10 ml.
Gelatin (10% water solution): 24 g
Sodium laurylsulfate (10% water solution): 2.75 ml.

The reference compounds E, F, G, H and I showed a poor solubility in the dispersion solvents and crystallized immediately even by increasing the solvent and the ethyl acetate quantity.

The obtained gelatin dispersions of the UV-absorbing compounds were added with a gelatin hardener and then coated onto a cellulose triacetate base at the coverage of 0.2 g/m² of the UV-absorber.

The following table reports the optical density values read at a spectrophotometer at 375 nm and 415 nm, respectively.

| Film | Comp. | $R_1$=$R_2$ | Optical density read at 375 nm | Optical density read at 415 nm |
|---|---|---|---|---|
| 5 | A | $C_6H_{13}$(n) | 0.85 | 0.46 |
| 6 | B | $C_4H_9$(n) | 1.15 | 0.56 |
| 7 | C | $C_3H_7$(n) | 1.42 | 0.38 |
| 8 | D | $CH_2$=CH—$CH_2$ | 1.94 | 0.16 |

The above reported data show that a gelatin coating containing dispersed therein the UV-absorbing compound of the present invention has a higher UV absorption and a higher absorption drop in the visible light, if compared with the reference UV-absorbing compounds.

EXAMPLE 4

Two gelatin dispersions of UV-absorbing compounds were prepared having the following compositions:

| Components | | Dispersions 1 | Dispersions 2 |
|---|---|---|---|
| Compound D | g | 4 | — |
| 2-(2'-hydroxy-3',5'-ditert.-butyl)-phenyl-5-tert.-butyl-benzotriazole (Compound L) | g | 4 | 4 |
| Tricresylphosphate | g | 1.5 | 1.5 |
| Ethylacetate | ml | 10 | 10 |
| Gelatin (10% water solution) | g | 24 | 24 |
| Sodium laurylsulfate (10% water solution) | g | 2.75 | 2.75 |

Three color reversal films (Films 9, 10 and 11) were each prepared by coating a cellulose triacetate base in the indicated order with two red-sensitive gelatin silver halide emulsion layers having incorporated therein cyan-forming couplers dispersed in the layers in oil particles, a gelatin intermediate layer, two green-sensitive gelatin silver halide emulsion layers having incorporated therein magenta-forming couplers dispersed in the layers in oil particles, a gelatin yellow colloidal silver filter layer, a blue-sensitive gelatin silver halide emulsion layer having incorporated therein yellow-forming couplers dispersed in the layers in oil particles and a gelatin protective layer.

The outermost protective layer was respectively comprising 2.6 g/m² of gelatin, dispersion 1 with a quantity of 0.18 g/m² of Compound D and 0.18 g/m² of the benzotriazole derivative (Film 9); 2.6 g/m² of gelatin, dispersion 1 with a quantity of 0.36 g/m² of Compound D and 0.36 g/m² of the benzotriazole derivative (Film 10); 2.6 g/m² of gelatin and dispersion 2 with a quantity of 0.36 g/m² of the benzotriazole derivative (Film 11).

Samples of the three films were bleached and fixed, without having been exposed, in a conventional color reversal processing (e.g. Kodak E6) and the transparent samples were read at a spectrophotometer. The enclosed drawings report the absorption curves of the three processed films. Curves 9 and 10 (concerning the materials including both compound D and compound L) show a complete protection against UV-radiations with a sharp absorption cut towards wavelengths above 400 nm. Curve 11, on the contrary, shows an insufficient absorption in the region comprised between 380 and 400 nm, while curve 10 shows a high absorption in the above mentioned region, without any substantial absorption above 400 nm for higher quantities of the compound of the present invention.

I claim:

1. A photographic element comprising a support base, at least one silver halide emulsion layer and at least one auxiliary layer over said silver halide emulsion layer, said photographic element being characterized by having at least one of said layers containing a dispersion of an ultraviolet radiation absorbing amount of 3-diallylaminoallylidenemalononitrile therein.

2. A photographic element of claim 1, in which said auxiliary layer is an external protective layer.

3. A photographic element according to claim 1, wherein said emulsion layer and said auxiliary layer are made of gelatin.

4. A photographic element according to claim 1, wherein said silver halide emulsion layer is optically sensitized.

5. A photographic element according to claim 1, wherein said silver halide emulsion layer has photoraphic couplers therein.

6. A photographic element according to claim 1, wherein said 3-diallylaminoallylidenemalononitrile is in solution in a high-boiling water-immiscible organic solvent.

7. A photographic element according to claim 6 wherein said 3-diallylaminoallylidenemalononitrile solution includes also a hydroxyphenylbenzotriazole in solution in the same high-boiling water-immiscible organic solvent.

* * * * *